US005332077A

United States Patent [19]

Ogimura

[11] Patent Number: 5,332,077

[45] Date of Patent: Jul. 26, 1994

[54] ESCALATOR APPARATUS

[75] Inventor: Yoshio Ogimura, Saitama, Japan

[73] Assignee: Kabushiki Kaisha Toshiba, Kawasaki, Japan

[21] Appl. No.: 901,969

[22] Filed: Jun. 22, 1992

[30] Foreign Application Priority Data

Jun. 28, 1991 [JP] Japan ..... 3-158601

[51] Int. Cl.[5] ..... B66B 23/12

[52] U.S. Cl. ..... 198/333; 198/324

[58] Field of Search ..... 198/324, 333

[56] References Cited

U.S. PATENT DOCUMENTS

| | | | |
|---|---|---|---|
| 4,557,369 | 12/1985 | Ishida et al. | 198/333 |
| 4,681,207 | 7/1987 | Goto et al. | 198/333 |
| 4,682,681 | 7/1987 | Teranishi et al. | 198/324 X |
| 5,024,314 | 6/1991 | Kitamura et al. | 198/333 |
| 5,062,519 | 11/1991 | Haruta | 198/333 |

FOREIGN PATENT DOCUMENTS

| | | | |
|---|---|---|---|
| 3046203 | 7/1982 | Fed. Rep. of Germany . | |
| 59-203085 | 11/1984 | Japan | 198/324 |
| 63-19437 | 4/1988 | Japan . | |
| 0261195 | 10/1989 | Japan | 198/324 |
| 0008190 | 1/1990 | Japan | 198/333 |
| 0013593 | 1/1990 | Japan | 198/333 |
| 0100989 | 4/1990 | Japan | 198/333 |
| 0100990 | 4/1990 | Japan | 198/333 |

*Primary Examiner*—James R. Bidwell
*Attorney, Agent, or Firm*—Foley & Lardner

[57] ABSTRACT

An escalator apparatus is comprised of a first specialized step, having a moveable tread which can rise and fall, and a second specialized step, which is adjacent to and above it and has a lift mechanism which can appear and disappear to support the moveable tread of the first specialized step. Both specialized steps are incorporated in a section of multiple steps which are arranged to run in an endless loop. When loading a wheeled conveyance, the lift mechanism projects and operates at a level section of an outward path, and runs on an inclined section while supporting the moveable tread at the same height as the second specialized step to guarantee an effective tread depth dimension for loading the wheeled conveyance. Furthermore, the construction provides guide means which tilts the moveable tread forward while it is being caused to rise to the same height as the second specialized step. Accordingly in the escalator apparatus, loading space for the wheeled conveyance can be easily guaranteed. In addition, there is no risk of the wheeled conveyance loaded on the escalator rolling down. As the escalator apparatus can transport the wheeled conveyance without pause, it can prevent a fall in the ability to transport wheeled conveyances and passengers.

9 Claims, 6 Drawing Sheets

ESCALATOR APPARATUS

BACKGROUND OF THE INVENTION

1. Field of the Invention

This invention relates to an escalator apparatus which can transport cars, for instance prams or wheelchairs for physically handicapped persons and the like, in addition to ordinary passengers.

In particular, it relates to an escalator apparatus having a construction which guarantees a tread depth dimension which is effective for loading the cars by maintaining at least two upper and lower steps at the same level.

2. Description of the Prior Art

Usually, in an ordinary escalator apparatus, since the depth dimension of each step is short, cars, for instance wheelchairs for disabled persons, cannot be safely transported by loading them in a level attitude. Because of this, steps of the escalator apparatus have recently been proposed which will maintain at least two upper and lower steps, out of the multiple steps which are arranged in an endless state, at the same height and can thus guarantee a car loading space with a deep depth.

For instance, the escalator apparatus described above is disclosed by Japanese Patent Publication No. 63-19437.

A proposed construction of this escalator apparatus is briefly described with reference to FIGS. 10 through 12.

First, as shown in FIG. 10, main frame 1 of the escalator apparatus is provided to span in an inclined state between upper and lower floors. A circuit composed of outward path 2 on the top side, return path 3 on the under side and reversing sections 4 and 5 at the upper and lower floor ends is constructed by arranging guide rails and step sprockets between upper and lower floor stepping on and off points 6 and 7 of main frame 1. This circuit is provided with multiple steps 8 arranged so that they can run and be driven in an endless state. Each step 8 has a respective tread 9 on its upper side and, at the same time, respective left and right pairs of front and rear wheels 10*a* and 10*b* underneath.

Out of these multiple steps 8, two upper and lower specialized steps 8A and 8B which are adjacent to each other are suitably specified for loading a wheelchair K. Out of these upper and lower two steps, as shown in FIGS. 11 and 12, the lower first specialized step 8A has a construction divided into a step main body 11, supported by front and rear wheels 10*a* and 10*b*, and moveable tread 12, which is housed so that it is capable of rising and falling relative to the step main body 11. On the other hand, the adjacent upper step, second specialized step 8B, has the same construction as an ordinary step 8, but has lift mechanism 13 constructed inside it.

This lift mechanism 13 has a construction provided with pairs of pinions 14 which rotate when energised from the main frame 1, racks 15 which engage with the pinions 14, and arms 16 which extend to the rear from the racks 15 on the left and right sides respectively.

Usually, as shown in FIG. 12, the left and right arms 16 of the lift mechanism 13 are withdrawn inside the second specialized step 8B and have no connection with the first specialized step 8A. Thus, all of steps 8, 8A and 8B move in the same way as ordinary escalator steps to transport general passengers.

Also, in the case of loading the wheelchair K on the first and second steps 8A and 8B, all of the steps are paused at the level section 2*a* of the outward path 2, and from the state shown in FIG. 12, the pinions 14 of the lift mechanism 13 are energised to rotate by the energising unit (not shown) from the main frame 1. The left and right arms 16 operate to project in the rear direction together with the racks 15 which are engaged, and support the moveable tread 12 of the first specialized step 8A from underneath. In this state, as it moves from the level section 2*a* to the inclined section 2*b* of the outward path 2, the moveable tread 12 of the first specialized step 8A is caused to rise relative to the step main body 11 by the support of the left and right arms 16. As shown in FIG. 11, it is maintained at the same height as the second specialized step 8B. Thus, a satisfactory loading space for wheelchairs is guaranteed. That is to say, the design is to guarantee a deeper tread depth dimension which is effective for wheelchair loading.

Also, another specialized step 8C, which becomes in a rear-tilted state only when in the wheelchair mode, is provided adjacent to the upper side of the second specialized step 8B to take account of the case when a satisfactory wheelchair loading space cannot be guaranteed by the first and second specialized steps 8A and 8B alone, that is to say to take account of the case when a foot-rest or the like is provided and projects in front of the wheelchair K.

In the prior art escalator apparatus such as that described above, the moveable tread 12 of the first specialized step 8A is supported by the lift mechanism 13 so that it is maintained at the same height as the second specialized step 8B. Therefore, a satisfactory loading space for the wheelchair K can be simply guaranteed. However, since the moveable tread 12 rises and is supported one-sidedly by the left and right arms 16 of the lift mechanism 13, the arms 16 may bend or tilt downward under the weight of the moveable tread 12 itself and the load of the wheelchair K and its user loaded on them. Therefore, the trailing edge of the moveable tread 12 may tilt rearward so that its trailing edge becomes lower than its leading edge. As a result, there is the problem of a great risk that the wheelchair K loaded on the moveable tread 12 may be subject to a shifting force in the downward direction and roll downwards.

In addition, in the prior art escalator apparatus such as that described above, when the movable tread 12 of the first specialized step 8A is maintained at the same height as the second specialized step 8B, and the wheelchair K is loaded on the moveable tread 12, all of the steps are made to pause.

Accordingly it has a problem in its ability to transport cars and passengers by the escalator apparatus.

SUMMARY OF THE INVENTION

It is an object of the invention to provide an escalator apparatus which can simply guarantee loading space for a car by raising and supporting a moveable tread of a specialized step to the same height as a step above it.

Another object of the invention is to provide an escalator apparatus capable of use for cars with great safety, in which there in no risk of the car rolling down, by preventing a rearward tilt of the moveable tread.

A further object of the invention is to provide an escalator apparatus which can raise and support the moveable tread of the specialized step to the same height as a step above it without pausing all the steps.

In order to achieve the above objects, the escalator apparatus comprises;

a first specialized step having a moveable tread which can rise and fall included as one of multiple steps which are arranged to move on an outward path and a return path formed in an endless loop between upper and lower floors;

a second specialized step having lift means for lifting the first specialized step and being set adjacent to the first specialized step; and guide means for supporting to incline the moveable tread of the first specialized step when the lift means lifts the first specialized step to the same height as the second specialized step.

In the escalator apparatus described above, the lift means of the second specialized step goes out at the level sections of the outward path between the upper and lower floor when the car for instance a wheelchair is loaded, and supports the moveable tread of the first specialized step.

DESCRIPTION OF THE PREFERRED EMBODIMENTS

The following is a description of this invention based on the Figures. For simplification of the description, the same symbols are applied to those parts which are the same as in the construction shown in FIGS. 10 through 12.

Figure 10:
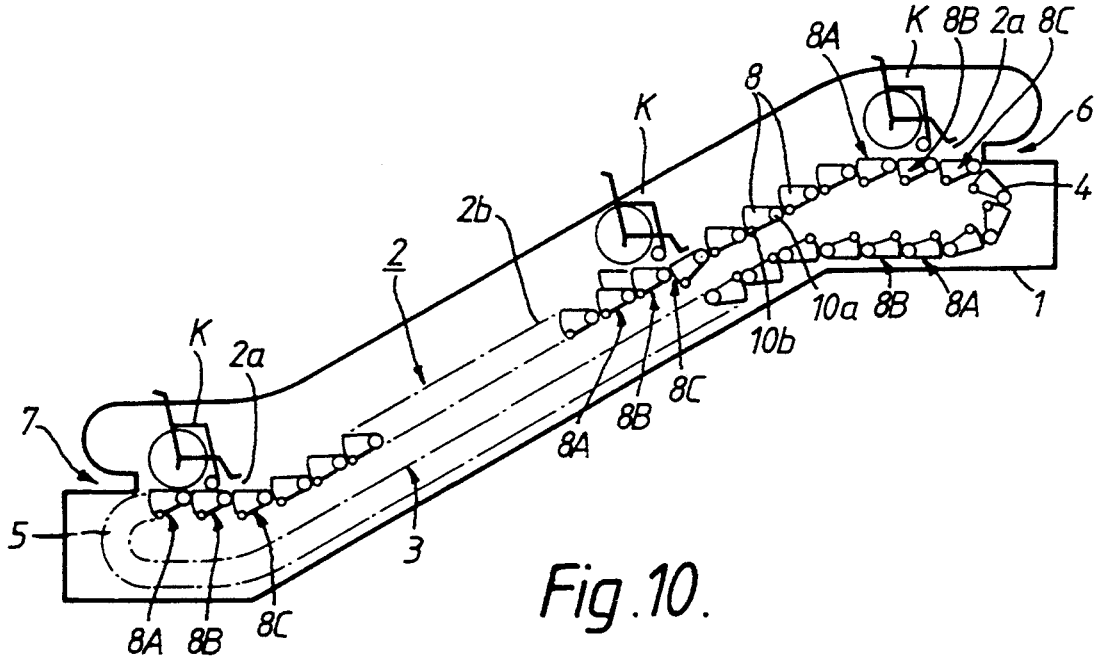
FIG. 10 is a schematic illustration showing a prior art escalator apparatus.

First, in the same way as shown in FIG. 10, the first specialized step 8A and the second specialized step 8B which is adjacent on its upper side are incorporated as part of the multiple steps 8 which are arranged and run in an endless circuit between upper and lower floor stepping on and off points 6 and 7. The first specialized step 8A is provided with the moveable tread 12 which can rise and fall relative to the step main body 11. The second specialized step 8B is provided with the lift mechanism 13 having a pair of arms 16 on its right and left which are capable of appearing and disappearing for supporting the rise of the moveable tread 12 of the first specialized step 8A. Also, taking account of the case of being unable to guarantee sufficient space for the loading wheelchair K and the like by the first and second specialized steps 8A and 8B alone, a third specialized step 8C is provided adjacent on the upper side of these steps so that it will tilt backward only when in the wheelchair loading mode.

In the first specialized step 8A, the guide mechanism 20 as guide means is provided which guides and supports the moveable tread 12 so that it can rise and fall relative to the step main body 11. The guide mechanism 20 is a double-X link system, like a type of pantograph provided at the left and right sides between the step main body 11 and the moveable tread 12.

The guide mechanism 20 has a construction in which a pair of lower links 21 and 22 pivoted by an axle-pin 23 to form an X-shape and a pair of upper links 24 and 25 pivoted by an axle-pin 26 to form a similar X-shape are placed one above the other and are linked and pivoted by axle-pins 27 and 28. These links are mounted as follows. The lower end of the lower link 21, which is in a state in which its front end is tilted upwards, is pivoted on the rear end of a side frame 29 of step main body 11 by an axle-pin 30. In the same way, the upper end of upper link 24, which is in a state in which its front end is tilted upwards, is pivoted near the front end of a lower frame 31 of the moveable tread 12 by an axle-pin 32. The lower end of the lower link 22, which is in a state in which its front end is tilted downwards, is engaged in a slot **29*a* of the front end of the side frame 29 of the step main body 11 via a sliding axle-pin 33, so that it can move back and forth. At the same time, the upper end of the upper link 25, which is in a state in which its front end is tilted downwards, is engaged in a slot 31*a* close to the rear end of the lower frame 31 of the moveable tread 12 via a sliding axle-pin 34**, so that it can move back and forth.

Here, in the guide mechanism 20 forming the double-X link system, the pair of the lower links 21 and 22 and the upper link 24, of which the front end is tilted upwards, are all three of the same length. Compared with these, only the upper link 25, of which the front end is tilted downward, is a little longer. The distances from the axle-pin 23, which is an articulation point, to the axle-pins 27, 28, 30 and 33 and the distances from the axle-pin 26, which is an articulation point, to the axle-pins 27, 28 and 32 are all equal. However, the distance from the axle-pin 26 to the axle-pin 34 is set slightly longer. Moreover, the upper end of the longer upper link 25 is bent in a slight dogleg.

Figure 1:
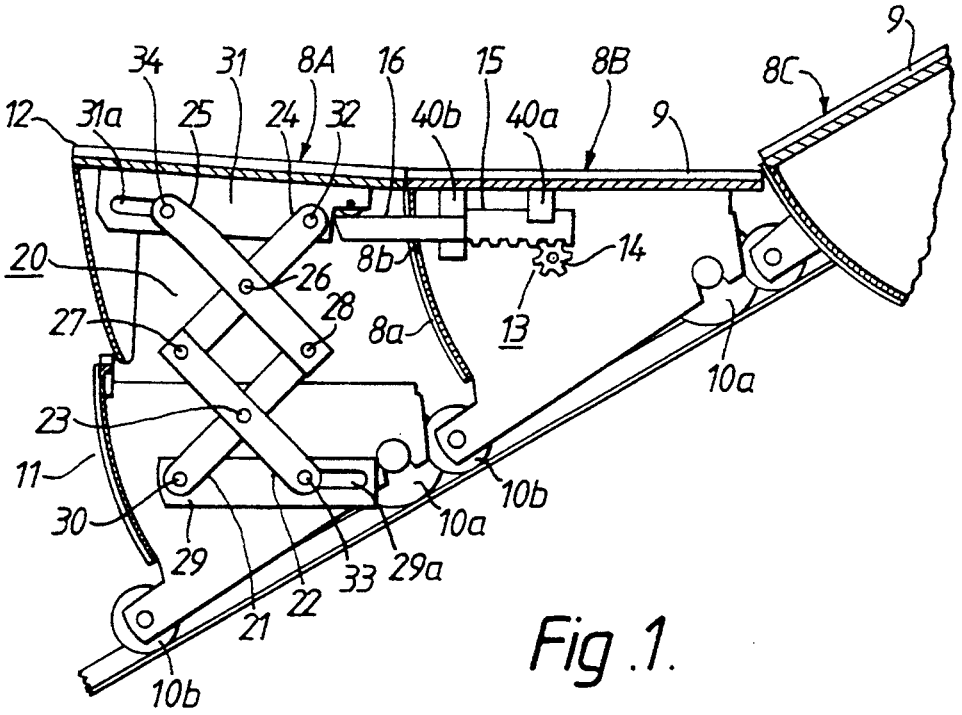
FIG. 1 is a sectional view showing a moveable tread in a raised state in an inclined section of a first embodiment of the invention.
Figure 2:
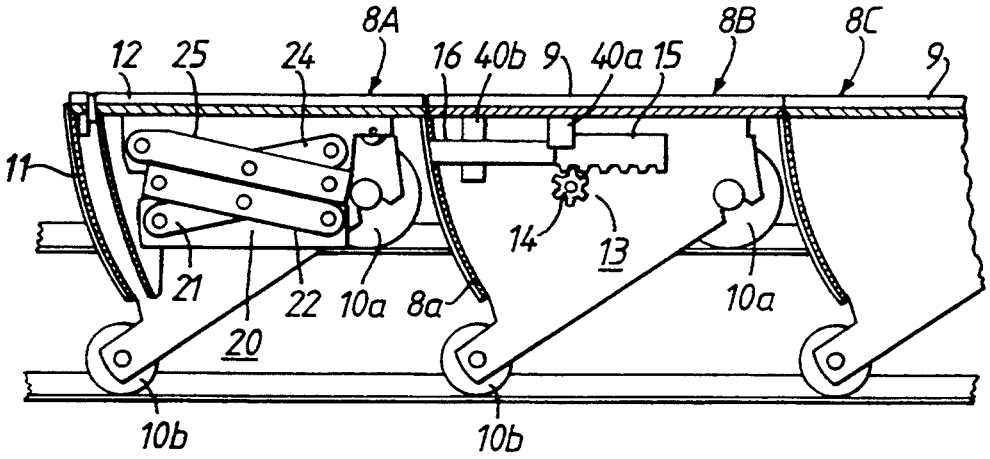
FIG. 2 is a sectional view showing a moveable tread in a lowered state in a level section of a first embodiment of the invention.
Figure 3:
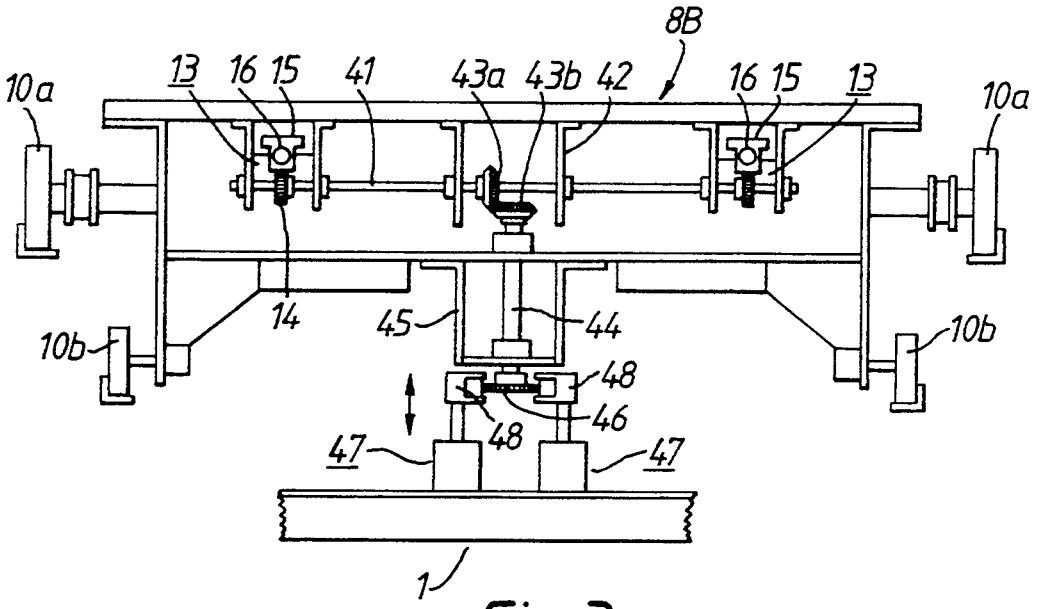
FIG. 3 is schematic diagram showing a second specialized step of a first embodiment of the invention.
Figure 4:
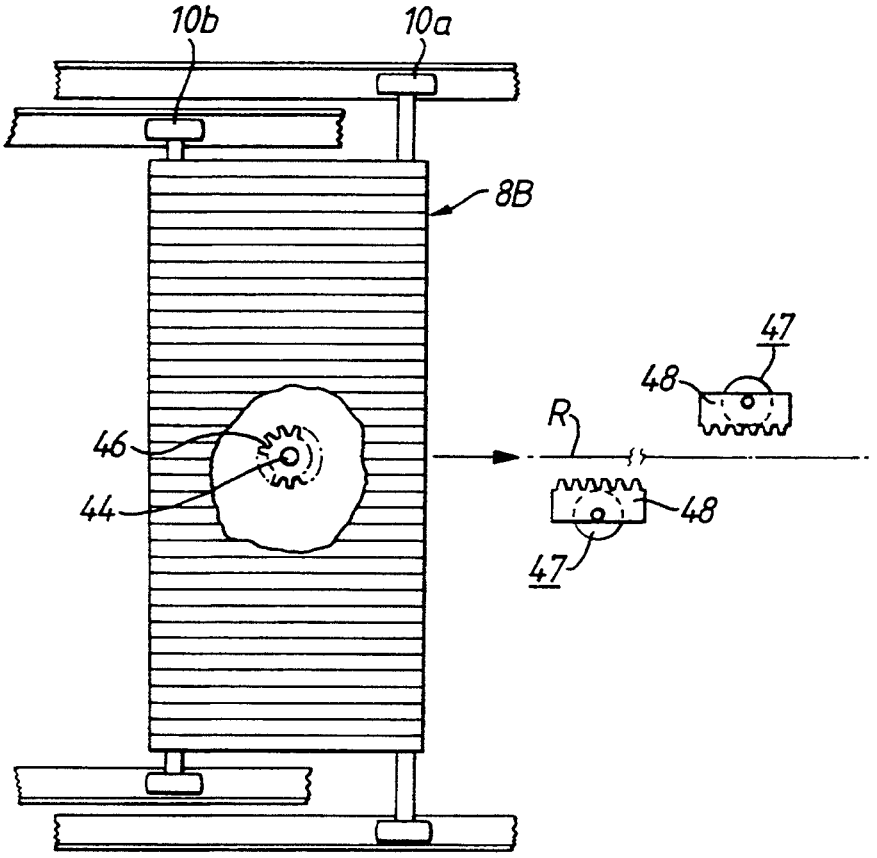
FIG. 4 is a portion broken top view showing a second specialized step and a drive means of the main frame side of a first embodiment of the invention.

In this way, the guide mechanism 20 is constructed so that it does not only simply guide and support the moveable tread 12 so that it can rise and fall (vertical parallel motion) relative to the step main body 11. The moveable tread 12 is supported by the lift mechanism 13 and rises to the same level as the second specialized step 8B. At the same time, as shown in FIG. 1, the links 21, 22 and 24 and the slightly longer link 25 extend and tilt the moveable tread 12 forward, so that its trailing edge is slightly higher than its leading edge. Moreover, during the descent of the moveable tread 12 relative to the step main body 11, as shown in FIG. 2, the links 21, 22 and 24 and the slightly longer link 25 are folded so that the moveable tread 12 returns to the level state.

Figure 11:
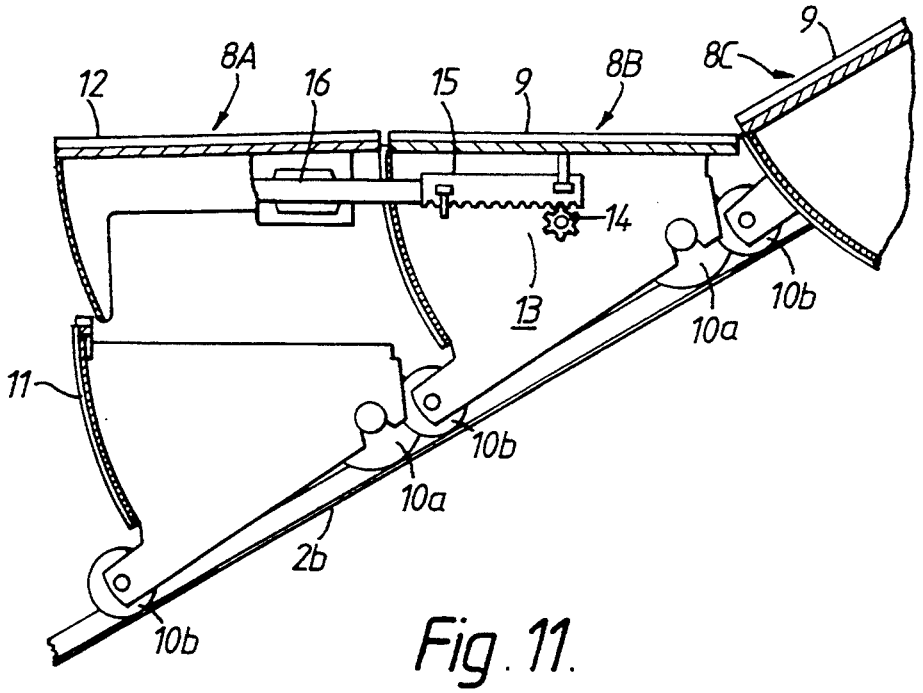
FIG. 11 is a sectional view showing a moveable tread in a raised state in an inclined section of a prior art escalator apparatus.
Figure 12:
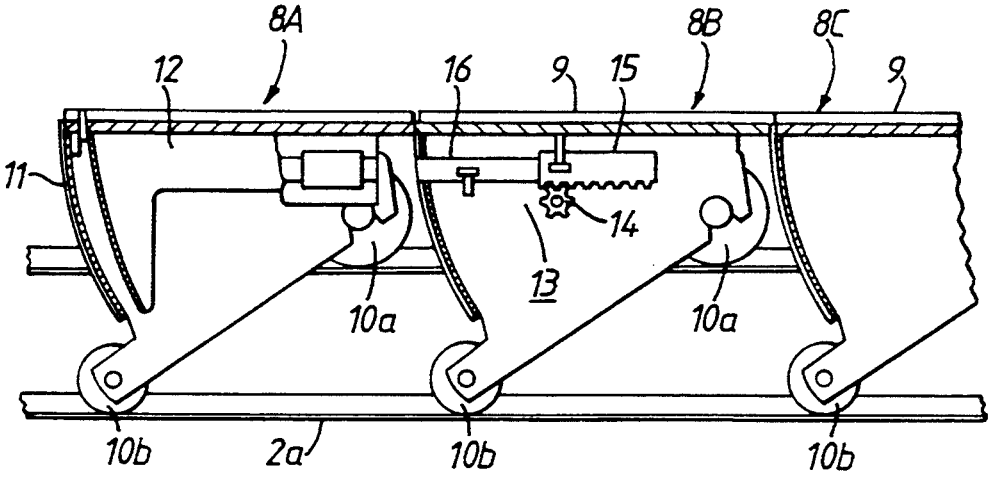
FIG. 12 is a sectional view showing a moveable tread in a lowered state in a level section of a prior art escalator apparatus.

The lift mechanism 13 installed in the second specialized step 8B, in the same way as the lift mechanism in FIG. 11 and 12, has a construction in which it is provided with the pinions 14 which rotate when energised from the main frame 1, the racks 15 which engage with the pinions 14 and the arms 16 which extend to the rear from the racks 15. These are provided in pairs on each side. The racks 15 and the arms 16 at each side are guided so that they can slide back and forth in a level state by slide guides 40*a* and 40*b* provided on the under side of the tread 9 of the second specialized step 8B. That is to say, the design is that the left and right arms 16 appear and disappear through the holes 8*b* in the cleated riser 8*a* of the second specialized step 8B via the racks 15, due to the forward and reverse rotation of the left and right pinions 14. The construction is that the moveable tread 12 of the first specialized step 8A is supported from beneath by the left and right arms 16 projecting rearwards.

The left and right pinions 14, which cause the appearance and disappearance of the left and right arms 16 by engaging with the racks 15, are installed on a single pinion shaft 41 which is provided in the width direction of the step via brackets 42 provided on the underside of the tread 9 of the second specialized step 8B. Also, a bevel gear 43*a* is installed almost in the centre of pinion shaft 41. Bevel gear 43*b*, which engages with this, is installed and supported on the upper end of a drive shaft 44 which is suspended via a bracket 45 in the second specialized step 8B. An input gear 46 is installed on the lower end of the drive shaft 44.

Also, energising units 47 are installed at each of the upper and lower floor sections 4*a* of the outward path 2. The design is that an input gear 46 is caused to rotate by engaging with drive racks 48 of the energising units 47 while it, together with the second specialized step 8B, transits the level section 4*a* of the outward path 2.

Usually, the respective drive rack 48 of the two energising units 47 at the upper and lower floors are withdrawn to a position in which they will not engage even if the input gear 46 approaches. The construction is such that each drive rack 48 is advanced to the position where it can engage with the input gear 46 only in the wheelchair loading mode. Moreover, the respective drive racks 48 of the two energising units 47 at the upper and lower floors are positioned where they will engage with the input gear 46 from opposite sides to each other in order to impart forward and reverse rotation alternately to the input gear 46.

In the escalator apparatus having steps of the above construction, usually, the energising units 47 at both the upper and lower floors cause each drive rack 48 to withdraw and not rotate the input gear 46. By this means, as shown in FIG. 2, the right and left arms 16 of the lift mechanism 13 remain withdrawn inside second specialized step 8B and have no connection with the first specialized step 8A. All steps 8, 8A and 8B thus move in the same way as ordinary escalator steps, and transport ordinary passengers.

Also, the wheelchair mode causes the drive racks 48 of both energising units 47 of the upper and lower floors to advance. For instance, when the escalator is in ascent operation, the input gear 46 engages with the drive rack 48 of its lower floor section and operates it in forward rotation. This energises the pinions 14 of the lift mechanism 13 with forward rotation. The left and right arms 16 are operated to project to the rear together with the racks 15 which engage with the pinions 14, and to support the moveable tread 12 of the first specialized step 8A from its underside.

In this state, in the process of the transit of the outward path 2 from the level section 2*a* to inclined section 2*b*, the moveable tread 12 of the first specialized step 8A is caused to rise relative to the step main body 11 and be maintained at the same level as the second specialized step 8B, as shown in FIG. 1, by the support of the left and right arms 16. When the moveable tread 12 is ascending, the trailing edge of the moveable tread 12 will rise while tilting forwards so that it is slightly higher than the leading edge. Even if there is deflection in the left and right arms 16, this deflection is compensated by the tilting and guiding operation of the guide mechanism 20, and the moveable tread 12 is accurately tilted forward.

And the third specialized step 8C is tilted backward only during the wheelchair mode.

This third specialized step 8C is described based on FIGS. 5 through 8.

The third specialized step 8C comprises a moveable tread 50*a* inclining not to interfere with wheels or a footrest of the wheelchair K, a step body 50*b* having long sideways holes 51 which support to be tilted and moved before and behind the moveable tread 50*a* and rack gears 52 having rack cogs which are disposed on a parallel with a cleat face of the third specialized step 8C and is disposed on the leading lower edge part of the step body 50*b* toward the before and behind directions of the step body 50*b*.

And the moveable tread 50*a* comprises a pair of left and right equipping arms 53 which are formed L-shaped and are disposed to each lower side of the leading edge, a tread shaft 55 which is adhered to each of the equipping arms 53 and is passed through the long sideways holes 51 of the step body 50*b* so that it can slide back and forth, and pinion gear 54 which engage with each of the rack gear 52 and is disposed to the edge of the tread shaft 55 in order to rotate with the tread shaft 55.

Figure 5:
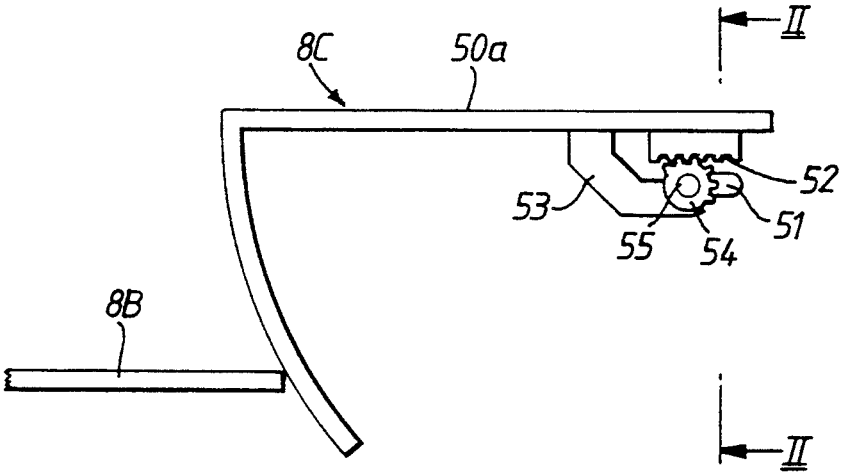
FIG. 5 is a vertical sectional schematic illustration showing a third specialized step of a first embodiment of the invention.
Figure 6:
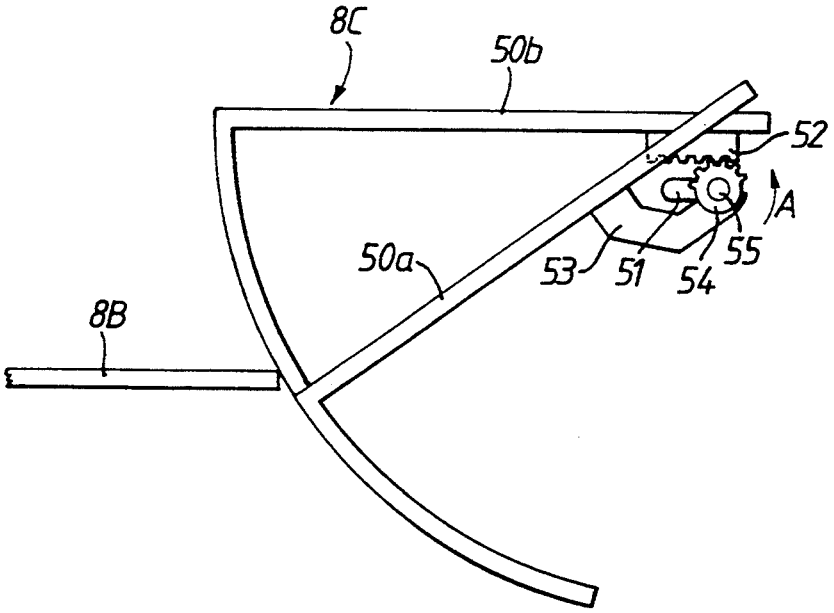
FIG. 6 is a vertical sectional schematic illustration showing an operation of a third specialized step of a first embodiment of the invention.
Figure 7:
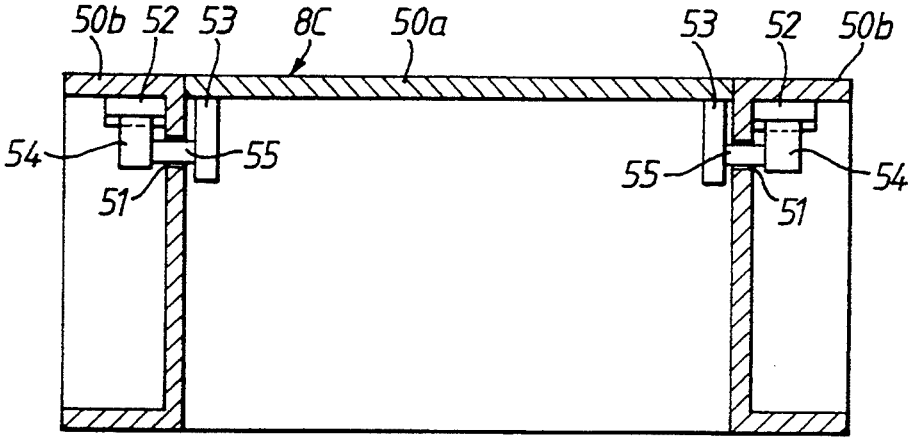
FIG. 7 is a sectional view taken on line II—II of FIG. 5.

As shown in FIG. 5, when the moveable tread 50*a* is level, the pinion Gear 54 is engaged with the back edge of the rack gear 52. And when the moveable tread 50*a* is inclined backward, the pinion gear 54 is rotated in the direction indicated by arrow A of FIG. 6 and the pinion gear 54 is moved to the front side of the rack gear 52 gradually.

At this time the rotating distance of the pinion gear 54 is decided by its diameter.

The moving distance to the front side of the moveable tread 50*a* is decided as follows.

Figure 8:
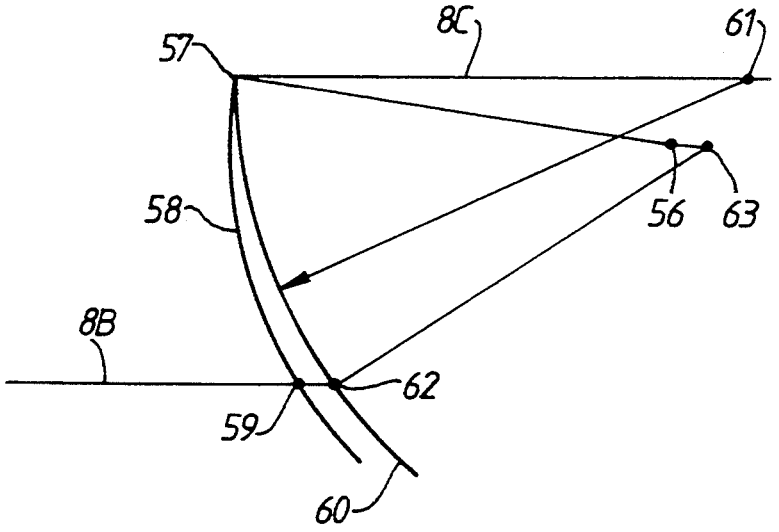
FIG. 8 is a diagram showing geometrically an inclined tread of a third specialized step of a first embodiment of the invention.

In FIG. 8, as the center of rotating of the moveable tread 50*a* is defined as a point 56, an upper edge 57 of the riser of the moveable tread 50*a* moves along a locus 58 and in case of inclining the riser of the moveable tread 50*a*, its edge is located at a point 59.

However as the outside of the riser of third specialized step 8C moves along a locus 60 which has a center point 61 on the cleat face of the third specialized step 8*c* as the rotating center, the moveable tread 50*a* protrudes for the distance between a point 59 and a point 62 backward. Actually the moveable tread 50*a* interferes with the second specialized step 8B disposed backward to the third specialized step 8C. Moreover the point 62 indicates a regular location of an inclining edge of the riser.

Accordingly when the moveable tread 50*a* finishes being inclined, the center of the rotation is moved to the front side for the distance between the points 59 and 62, namely the diameter of the pinion gear 54 is decided to move to a point 63 from the point 56.

By this means, even when running in inclined section 2*b* the moveable tread 12 of the first specialized step 8A and the second specialized step 8B are maintained at the same level, and satisfactorily guarantee an effective depth of tread for wheelchair loading. At the same time, by the tilting forward of the moveable tread 12, a transit force toward the upper floor is applied to the wheelchair K. Therefore, movement toward the lower floor, with its great risk of the wheelchair rolling down, is prevented. Thus, safe transport is achieved.

Also, in the process of the transit of the outward path 2 from the inclined section 26 to the level section 2*a*, the moveable tread 12 of the first specialized step 8A is caused to descend relative to the step main body 11 to the same height as the second specialized step 8B while being supported by the left and right arms 16. As shown in FIG. 1, the moveable tread 12 returns to the level state due to the guide mechanism 20. In this state, it runs on the upper floor section, and the input gear 46 is caused to engage with the drive rack 48 of the energising unit 47 during this run. The pinions 14 of the lift mechanism 13 are energised in reverse rotation, and the left and right arms 16 move forward together with the racks 15, which are engaged with the pinions 14, and withdraw inside the second specialized step 8B. Thus, the support for the moveable tread 12 of the first specialized step 8A is released. By this means, the first and second specialized steps 8A and 8B return to normal running operation in the same way as the other steps 8.

It has as described above, the third specialized step 8C is altered from the inclined state into the level state.

Figure 9:
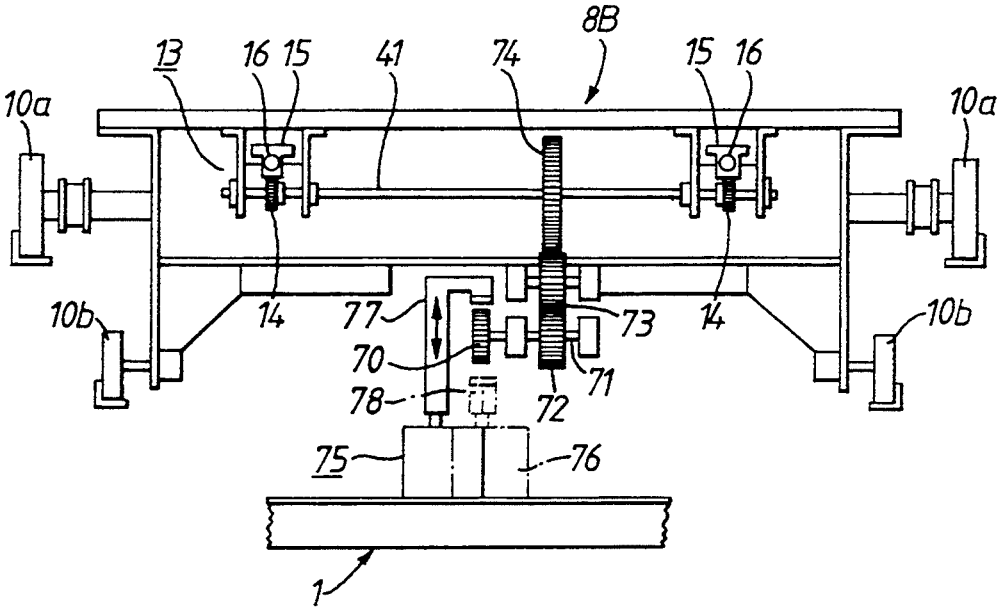
FIG. 9 is a portion broken top view showing another embodiment of a second specialized step and a drive means of main frame side of the invention.

Moreover another construction about the second specialized step and the energising units is described FIG. 9.

This construction is that a forward and reverse rotation pinion 70 is equipped with a edge of a horizontal pinion shaft 71 mounted transversely, which is a flat pinion as as input forward and reverse rotation means for receiving forward and reverse rotation force which moves in and out the left and right arms 16 of the lift mechanism 13 from the side of the main frame 1. And a spur gear 72 is equipped on the other edge of the pinion shaft 71, and transmits the drive force. Further a spur gear 73 which engages with the spur gear 72 is provided, and a spur gear 74 which engages with the spur gear 73 is mounted on the pinion shaft 42 having left and right pinions 14 which are parallel.

Drive units 75, 76 are disposed to two places where are the upper and lower floor of the side of the main frame 1 and are rotated the forward and reverse rotation pinion 70 of the lift mechanism 13 in the forward and reverse directions. And drive racks 77, 78 of the drive units 75, 76 rise and fall to a fixed height via motor driving, and are operated to engage with the forward and reverse rotation pinion 70 according to the direction of moving of the steps 8.

In the above embodiment, the lift mechanism is separated from the guide mechanism, but another embodiment is considered that the lift mechanism is combined with the guide mechanism, namely the guide mechanism is comprised of means of the lift mechanism and the moveable tread of the first specialized step is supported at the same height as the second specialized step by the guide mechanism having means of the lift mechanism.

Also, the lift mechanism described above is a double-X link system, but another example is considered that it is a cylinder system or a cam system.

Although the invention has been described in its preferred form with a certain degree of particularity, it is understood that the present disclosure of the preferred form may be changed in the details of construction and combination and be arrangement of parts may be resorted to without departing from the spirit and the scope of the invention as hereinafter claimed.

In the invention as described above, the moveable tread of a specialized step is raised and supported at the same height as the step above it by the lift mechanism. Thus, loading space for a car can be simply guaranteed. In addition, the moveable tread can be tilted forward by the guide mechanism when the moveable tread rises. Thus, there is no risk of a car loaded on it rolling down. Therefore, an effectiveness which can greatly improve safely, both essentially and visually, is obtained.

As the escalator apparatus can transport cars without pause, it can prevent disruptions in the ability of transportation on the escalator apparatus.

What is claimed is:

1. An escalator apparatus which transports wheeled conveyances in addition to passengers comprising:

a first specialized step having a moveable tread which can rise and fall included as one of multiple steps which are arranged to move on an outward path and a return path formed in an endless loop between upper and lower floors;

a second specialized step having lift means for lifting the first specialized step and being set adjacent to the first specialized step; and guide means for supporting and tilting the moveable tread of the first specialized step with respect to the second specialized step when the lift means lifts the first specialized step to the same height as the second specialized step.

2. An escalator apparatus as claimed in claim 1, in which a third specialized step is disposed adjacent to the second specialized step, the third specialized step having a moveable tread which can tilt with respect to the second specialized step, and having a step body which can support the tilted moveable tread of the third specialized step.

3. An escalator apparatus as claimed in claim 1, in which the guide means is comprised of a pair of lower links pivoted by a first axle-pin to form an X-shape and a pair of upper links pivoted by a second axle-pin to form an X-shape, the two X-shape being placed one above the other and linked and pivoted by a set of third axle-pins.

4. An escalator apparatus as claimed in claim 1, in which the lift means operates to raise the moveable tread of the first specialized step while the steps move.

5. An escalator apparatus as claimed in claim 2, wherein the third specialized step includes an arm connected to the moveable tread, a shaft connected to the arm and extending through a hole in the step body, a pinion gear connected to the shaft, and a rack mounted on the step body and engaging the pinion gear.

6. An escalator apparatus which transports wheeled conveyances in addition to passengers comprising:

a first specialized step having a moveable tread which can rise and fall included as one of multiple steps which are arranged to move on an outward path and a return path formed in an endless loop between an upper and lower floor;

a second specialized step having lift means for lifting the first specialized step and being set adjacent to the first specialized step; and tilting supporting means for tilting the movable tread of the first specialized step with respect to the second specialized step and for supporting the tilted first specialized step without interfering with other steps.

7. An escalator apparatus which transports wheeled conveyances in addition to passengers comprising:

a first specialized step having a moveable tread which can rise and fall included as one of multiple steps which are arranged to move on an outward path and a return path formed in an endless loop between an upper and lower floor;

a second specialized step having lift means for lifting the first specialized step and being set adjacent to the first specialized step;

a pair of drive units installed at each of the outward and return paths, one for engaging the lift means and the other for disengaging the lift means; and guide means for supporting the moveable tread of the first specialized step when the lift means lifts the first specialized step to the same height as the second specialized step.

8. An escalator apparatus as claimed in claim 7, in which the lift means operates to raise the moveable tread of the first specialized step while the steps move.

9. An escalator apparatus as claimed in claim 7, wherein each drive unit includes a raising and lowering device, and a drive rack connected to the raising and lowering device.

* * * * *